US009107002B2

(12) United States Patent
Fujitani

(10) Patent No.: US 9,107,002 B2
(45) **Date of Patent: *Aug. 11, 2015**

(54) LOUDSPEAKER DIAPHRAGM AND LOUDSPEAKER USING THE SAME

(71) Applicant: Onkyo Corporation, Osaka (JP)

(72) Inventor: Takeshi Fujitani, Osaka (JP)

(73) Assignee: Onkyo Corporation, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/833,922

(22) Filed: Mar. 15, 2013

(65) Prior Publication Data

US 2013/0259291 A1 Oct. 3, 2013

(30) Foreign Application Priority Data

Apr. 2, 2012 (JP) ..... 2012-083923

(51) Int. Cl.

| | |
|---|---|
| ***H04R 7/00*** | (2006.01) |
| ***H04R 7/12*** | (2006.01) |
| ***H04R 7/18*** | (2006.01) |
| ***H04R 31/00*** | (2006.01) |

(52) U.S. Cl.

CPC ..... *H04R 7/127* (2013.01); *H04R 7/18* (2013.01); *H04R 31/003* (2013.01); *H04R 2307/025* (2013.01)

(58) Field of Classification Search

CPC ..... H04R 7/00; H04R 7/02; H04R 7/06; H04R 7/12; H04R 7/122; H04R 7/125; H04R 7/127; H04R 7/14; H04R 7/16; H04R 7/18; H04R 7/20; H04R 7/22; H04R 31/00; H04R 31/003; H04R 31/006; H04R 2207/021; H04R 2231/001; H04R 2231/003; H04R 2307/00; H04R 2307/025; H04R 2307/201; H04R 2307/204; H04R 2307/207; G10K 13/00

USPC ..... 381/396, 398, 426, 430–342; 181/157, 181/167, 171–172

See application file for complete search history.

(56) References Cited

U.S. PATENT DOCUMENTS

| | | | | |
|---|---|---|---|---|
| 6,171,534 | B1 * | 1/2001 | Leach et al. | 264/102 |
| 6,183,674 | B1 * | 2/2001 | Nonogaki | 264/46.4 |
| 8,755,557 | B2 * | 6/2014 | Fujitani et al. | 381/398 |
| 2009/0312449 | A1 * | 12/2009 | Sasaki et al. | 521/148 |
| 2011/0317869 | A1 | 12/2011 | Fujitani et al. | |

FOREIGN PATENT DOCUMENTS

| | | |
|---|---|---|
| JP | 2007-295239 | 11/2007 |
| JP | 2012-010127 | 1/2012 |
| WO | WO 2008/023852 A1 | 2/2008 |

* cited by examiner

*Primary Examiner* — Brian Ensey
*Assistant Examiner* — Sabrina Diaz
(74) *Attorney, Agent, or Firm* — Renner, Otto, Boisselle & Sklar, LLP

(57) ABSTRACT

A loudspeaker diaphragm includes a diaphragm portion and an edge portion, which is molded integrally with the diaphragm portion and made of a material different from a material for the diaphragm portion. The edge portion contains at least one thermoplastic polymer (I), in combination with a block polymer (II). The at least one thermoplastic polymer (I) is selected from a block copolymer (I-a) which contains a polymer block (A) having a repeating structural unit derived from an aromatic vinyl compound and a polymer block (B) having a repeating structural unit derived from a conjugated diene, and an addition hydrogenated block copolymer (I-b) of the block copolymer (I-a). The block copolymer (II) contains a polymer block (C) having a repeating structural unit derived from an olefin compound and a polymer block (D) having a repeating structural unit derived from a (meth)acrylic compound.

11 Claims, 6 Drawing Sheets

LOUDSPEAKER DIAPHRAGM AND LOUDSPEAKER USING THE SAME

RELATED APPLICATION DATA

This application claims the benefit of Japanese Patent Application No. 2012-083923, filed Apr. 2, 2012, the disclosure of which is incorporated herein by reference in its entirety.

BACKGROUND OF THE INVENTION

1. Field of the Invention

The present invention relates to a loudspeaker diaphragm and a loudspeaker using the same.

2. Description of the Related Art

In general, a vibration system member, such as a loudspeaker diaphragm to be used in a loudspeaker, is obtained by assembling respective members, such as a diaphragm, an edge, and a gasket, each molded into a predetermined shape, using an adhesive. The vibration system member thus obtained has a problem in that poor bonding may be caused depending on the combination of the respective members, and a problem in that characteristics may fluctuate due to a variation in adhesive application amount. Further, in order to prevent an operation failure of the loudspeaker, it is necessary to use a highly-accurate assembly jig, which leads to a problem of poor productivity. In addition, in a case of using a less adhesive material (for example, olefin-based thermoplastic resin), a process such as primer application is further required prior to adhesive application, which leads to problems with productivity and production cost.

In order to solve the above-mentioned problems, integral molding of the diaphragm, the edge, and the gasket by a double molding method has been proposed (Japanese Patent Application Laid-open No. Hei 7-15793). However, the loudspeaker diaphragm obtained in this way has a problem in adhesion between the diaphragm and the edge at the time of large amplitude.

Further, in the double molding method, thermoplastic elastomers capable of being injection molded are mainly used as edge-forming materials. However, in a loudspeaker which is configured with only an edge as a suspension without the use of a damper (e.g., micro-speaker), it is necessary to reduce hardness (increase flexibility) of the edge itself in order to broaden low-frequency reproduction. Thus, there was a limit to balance hardness, strength and elongation for conventional thermoplastic elastomers.

In contrast, it has been proposed that a low-hardness speaker edge is formed by a specific thermoplastic elastomer (Japanese Patent Application Laid-open No. 2009-65476). However, while the edge formed by this thermoplastic elastomer has an improved heat resistance and an improved weather resistance, there is a problem that adhesion of the edge to a diaphragm is reduced, and thus resulting in reduced durability.

SUMMARY OF THE INVENTION

The present invention has been made to solve the above-mentioned conventional problems, and an object of the present invention is therefore to provide a loudspeaker diaphragm including an edge portion which has both elongation and strength, the loudspeaker diaphragm in which adhesion between the edge portion and a diaphragm portion is excellent, and provide a loudspeaker including the loudspeaker diaphragm.

According to an aspect of the present invention, a loudspeaker diaphragm is provided. The loudspeaker diaphragm includes: a diaphragm portion; and an edge portion, which is molded integrally with the diaphragm portion and made of a material different from a material for the diaphragm portion, wherein: the edge portion contains at least one thermoplastic polymer (I), in combination with a block polymer (II); the at least one thermoplastic polymer (I) is selected from a block copolymer (I-a) which contains a polymer block (A) having a repeating structural unit derived from an aromatic vinyl compound and a polymer block (B) having a repeating structural unit derived from a conjugated diene, and an addition hydrogenated block copolymer (I-b) of the block copolymer (I-a); and the block copolymer (II) contains a polymer block (C) having a repeating structural unit derived from an olefin compound and a polymer block (D) having a repeating structural unit derived from a (meth)acrylic compound.

In a preferred embodiment of the present invention, the edge portion contains 5 parts by weight to 95 parts by weight of the block copolymer (II) with respect to 100 parts by weight of the thermoplastic polymer (I).

In a preferred embodiment of the present invention, a hydrogenation rate of the addition hydrogenated block copolymer (I-b) is 70% or more with respect to the number of moles of an unsaturated double bond contained in the polymer block (B).

In a preferred embodiment of the present invention, the conjugated diene is selected from at least one of isoprene, butadiene, and hexadiene.

In a preferred embodiment of the present invention, the (meth)acrylic compound is selected from at least one of methyl methacrylate, ethyl acrylate, acrylic acid, acrylonitrile, 2-ethylhexyl(meth)acrylate, dodecyl(meth)acrylate, 2-hydroxyhexyl(meth)acrylate and glycidyl(meth)acrylate.

In a preferred embodiment of the present invention, the edge portion further contains at least one selected from an olefin polymer (III) and process oil.

In a preferred embodiment of the present invention, the edge portion contains 10 parts by weight to 500 parts by weight of at least one selected from the olefin polymer (III) and the process oil with respect to 100 parts by weight of the thermoplastic polymer (I).

In a preferred embodiment of the present invention, the edge portion contains 5 parts by weight to 95 parts by weight of the block copolymer (II) with respect to 100 parts by weight of the total of the thermoplastic polymer (I) and at least one selected from the olefin polymer (III) and the process oil.

In a preferred embodiment of the present invention, the edge portion has a JIS-A hardness of 15° to 55°.

In a preferred embodiment of the present invention, the edge portion is a foam material.

In a preferred embodiment of the present invention, the loudspeaker diaphragm further includes a gasket portion which is made of the same material as a material for the diaphragm portion and is molded integrally with and bonded to an outer peripheral portion of the edge portion.

According to another aspect of the present invention, a loudspeaker is provided. The loudspeaker of the present invention includes the loudspeaker diaphragm of the present invention.

According to another aspect of the present invention, a thermoplastic elastomer containing at least two specific polymer components is used as a material for forming the edge portion, and the edge portion is molded integrally with the diaphragm portion. Thus, the edge portion has both elongation and strength, and adhesion of a bonding portion between the edge portion and the diaphragm portion can be improved.

DETAILED DESCRIPTION OF THE PREFERRED EMBODIMENTS

A. Loudspeaker Diaphragm and Entire Structure of Loudspeaker

Figure 1A:
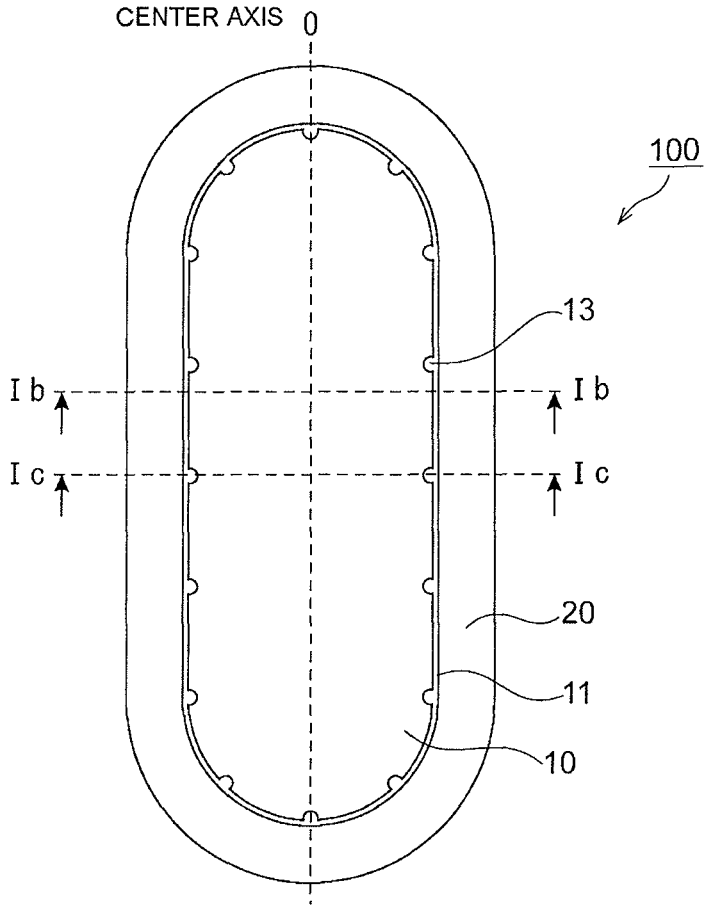
FIG. 1A is a schematic plan view of a loudspeaker diaphragm according to a preferred embodiment of the present invention.
Figure 1B:
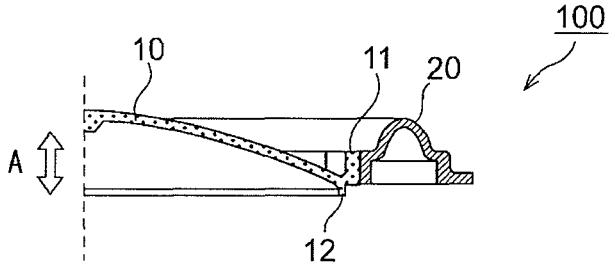
FIG. 1B is a cross-sectional view of a main part of the loudspeaker diaphragm taken along the line Ib-Ib of FIG. 1A.
Figure 1C:
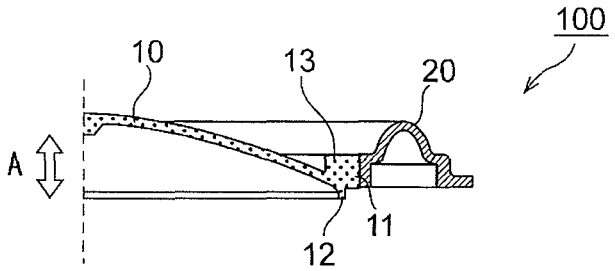
FIG. 1C is a cross-sectional view of a main part of the loudspeaker diaphragm taken along the line Ic-Ic of FIG. 1A.

FIG. 1A is a schematic plan view of a loudspeaker diaphragm according to a preferred embodiment of the present invention. FIG. 1B is a cross-sectional view of a main part of the loudspeaker diaphragm taken along the line Ib-Ib of FIG. 1A. FIG. 1C is a cross-sectional view of a main part of the loudspeaker diaphragm taken along the line Ic-Ic of FIG. 1A. It should be noted that FIG. 1B and FIG. 1C omit illustration of a left half of the loudspeaker diaphragm, which is symmetrical to a right half thereof with respect to a center axis passing a point O, and that FIG. 1A has a scale different from scales of FIG. 1B and FIG. 1C. A loudspeaker diaphragm 100 includes a diaphragm portion 10 and an edge portion 20 made of a material different from a material for the diaphragm portion 10. The edge portion 20 is bonded to an outer peripheral portion of the diaphragm portion 10. The diaphragm portion 10 preferably includes, at an outer peripheral end thereof, a tubular outer wall portion 11 provided upright in a direction substantially parallel to a vibrating direction A of the diaphragm portion 10 (hereinafter, simply referred to as vibrating direction A). In this case, the diaphragm portion 10 and the edge portion 20 are bonded to each other so that an outer peripheral surface of the outer wall portion 11 and an inner peripheral surface of the edge portion 20 are held in close contact with each other. Further, a height of the outer wall portion 11 is preferably larger than a thickness of the diaphragm portion 10.

As described above, when the outer wall portion 11 of the diaphragm portion 10 is provided upright in the direction substantially parallel to the vibrating direction A, a direction of a bonding surface of a bonding portion between the diaphragm portion 10 and the edge portion 20 is substantially parallel to the vibrating direction A. Owing to such bonding between the diaphragm portion 10 and the edge portion 20, the edge portion 20 is less likely to be affected by the vibration of the diaphragm portion 10. Further, when the height of the outer wall portion 11 is larger than the thickness of the diaphragm portion 10, the bonding portion formed on the outer peripheral surface of the outer wall portion 11 is excellent in bonding strength. As a result, antiresonance in the diaphragm portion 10 and the edge portion 20 is suppressed, and hence it is possible to obtain a loudspeaker diaphragm having less divided vibration.

In one embodiment, the thickness of the diaphragm portion 10 is preferably 0.1 mm to 0.3 mm. Regarding the thickness of the outer wall portion 11, a thickness of a portion in which a protruding portion 13 is not formed (the thickness of the outer wall portion 11 in FIG. 1B) is preferably 0.1 mm to 0.3 mm in a radial direction, and a thickness of a portion in which a protruding portion 13 is formed (the thickness of the outer wall portion 11 in FIG. 1C) is preferably 0.5 mm to 0.7 mm in the radial direction. The height of the outer wall portion 11 is preferably 0.5 mm to 1 mm, more preferably 0.75 mm to 1 mm. Note that, a thickness of the edge portion 20 is preferably 0.1 mm to 0.3 mm.

The diaphragm portion 10 preferably includes a voice coil guide portion 12 extending below the outer wall portion 11. The voice coil guide portion 12 is provided as a part of the diaphragm portion 10. When the voice coil guide portion 12 is provided at such a position, a voice coil may be arranged at a position close to the bonding portion between the diaphragm portion 10 and the edge portion 20, and hence it is possible to obtain a loudspeaker having less divided vibration. In one embodiment, as in the illustrated example, the voice coil guide portion 12 extends below the outer wall portion 11 on an inner side (center side) with respect to the outer peripheral surface of the outer wall portion 11, and is formed so that a step is provided between the outer peripheral surface of the outer wall portion 11 and the voice coil guide portion 12. Provision of this step allows easy attachment and fixation of the voice coil.

As illustrated in FIG. 1A, the outer wall portion 11 may include the protruding portion 13 protruding from the outer peripheral surface of the outer wall portion. The protruding portion 13 may protrude into an inner side (a center side) or an outer side of the outer peripheral surface of the outer wall portion 11, or may protrude into both the inner side and the outer side of the outer peripheral surface of the outer wall portion. As in the illustrated example, the protruding portion 13 preferably protrudes into the inner side of the outer peripheral surface. When the protruding portion 13 is provided, it is easy to perform releasing from a die after molding. A plurality of protruding portions 13 may be provided at substantially equal intervals in a circumferential direction of the outer wall portion 11 of the diaphragm portion 10.

Figure 2A:
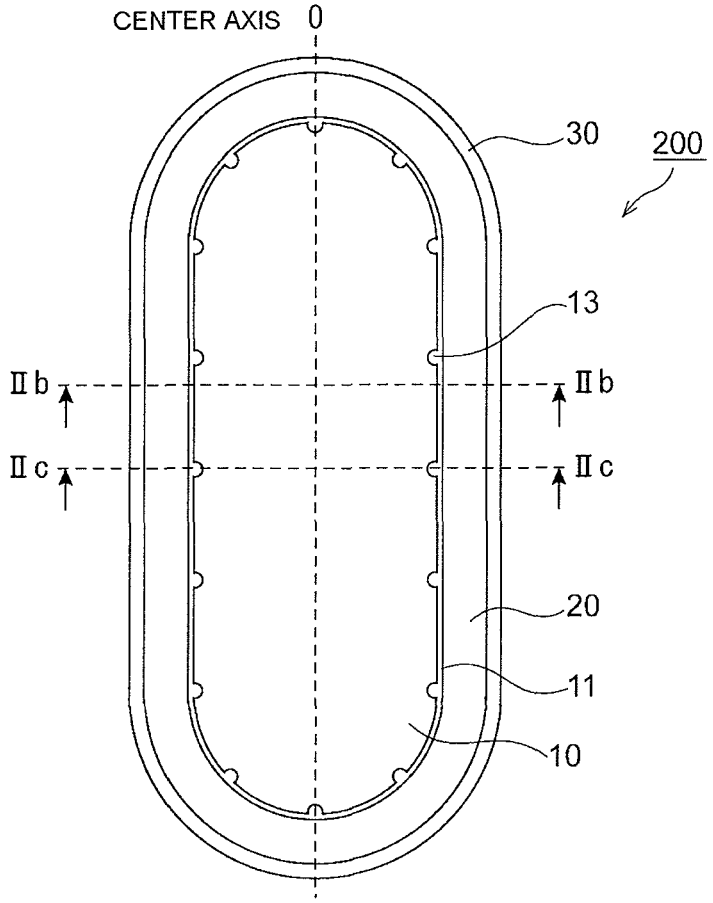
FIG. 2A is a schematic plan view of a loudspeaker diaphragm according to another preferred embodiment of the present invention.
Figure 2B:
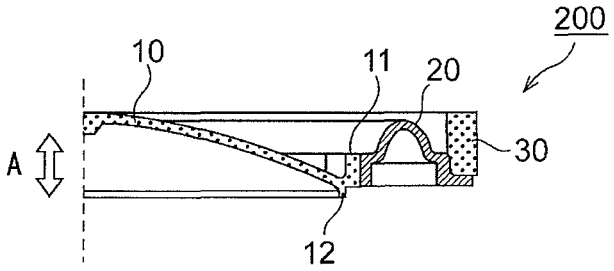
FIG. 2B is a cross-sectional view of a main part of the loudspeaker diaphragm taken along the line IIb-IIb of FIG. 2A.
Figure 2C:
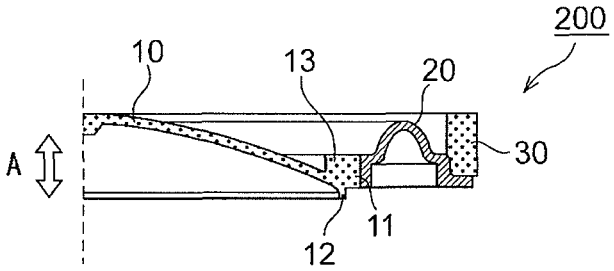
FIG. 2C is a cross-sectional view of a main part of the loudspeaker diaphragm taken along the line IIc-IIc of FIG. 2A.

FIG. 2A is a schematic plan view of a loudspeaker diaphragm according to another preferred embodiment of the present invention. FIG. 2B is a cross-sectional view of a main part of the loudspeaker diaphragm taken along the line IIb-IIb of FIG. 2A. FIG. 2C is a cross-sectional view of a main part of the loudspeaker diaphragm taken along the line IIc-IIc of FIG. 2A. It should be noted that FIG. 2B and FIG. 2C omit illustration of the left half of the loudspeaker diaphragm, which is symmetrical to the right half thereof with respect to the center axis passing the point O, and that FIG. 2A has a scale different from scales of FIG. 2B and FIG. 2C. A loudspeaker diaphragm 200 further includes a gasket portion 30 bonded onto the outer peripheral portion of the edge portion 20.

The loudspeaker diaphragm according to the present invention is an integrally molded product. In other words, the above-mentioned diaphragm portion and the edge portion are integrated with each other without using an adhesive. Further, in a case where the loudspeaker diaphragm includes the gasket portion, the diaphragm portion, the edge portion, and the gasket portion may be integrated with one another without using an adhesive. With this configuration, it is possible to obtain a loudspeaker diaphragm which has less divided vibration and high bonding strength because respective members are firmly welded together. Further, there is no problem with a variation in adhesive application amount, and hence it is possible to obtain a loudspeaker diaphragm excellent in stability of quality. In addition, the number of components and man-hours can be reduced, and hence it is possible to obtain a loudspeaker and a loudspeaker diaphragm at low cost.

Figure 3:
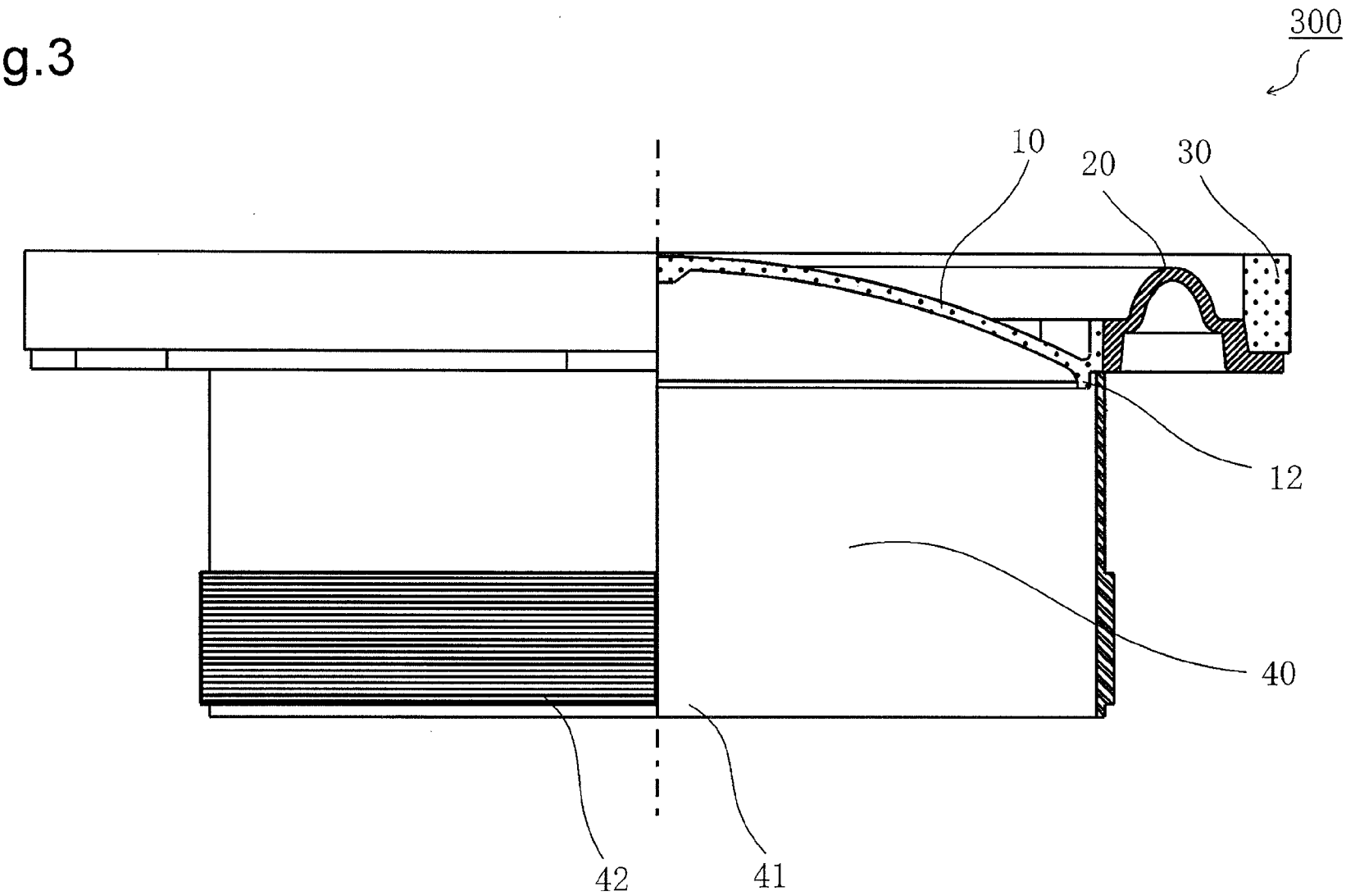
FIG. 3 is a schematic view of a loudspeaker according to a preferred embodiment of the present invention.
Figure 4:
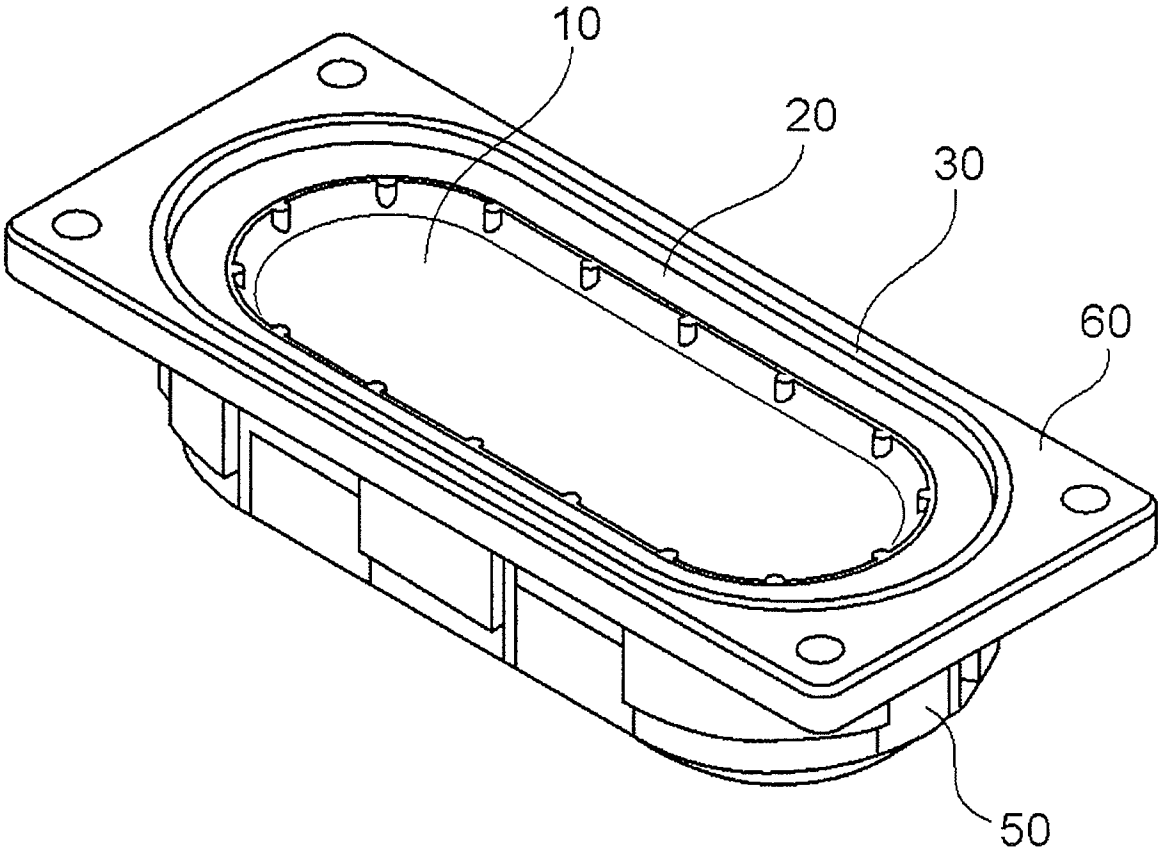
FIG. 4 is a schematic perspective view of a loudspeaker according to another preferred embodiment of the present invention.

FIG. 3 is a schematic view of a loudspeaker according to a preferred embodiment of the present invention. A left half of FIG. 3 schematically illustrates a side surface of the loudspeaker, and a right half thereof schematically illustrates a cross-section of the loudspeaker. A loudspeaker 300 includes the loudspeaker diaphragm 100 or 200 (loudspeaker diaphragm 200, in the illustrated example) and a voice coil 40. The voice coil 40 is fitted to the above-mentioned voice coil guide portion 12 of the loudspeaker diaphragm. The voice coil 40 preferably has a configuration in which a coil 42 is wound around a cylindrical bobbin 41. The end portion of the bobbin 41 is inserted into the voice coil guide portion 12 of the loudspeaker diaphragm, and is bonded using any appropriate adhesive (for example, rubber-based adhesive, epoxy-based adhesive, ultraviolet curing adhesive, or instant adhesive). Note that, in a case where the loudspeaker diaphragm does not include the gasket portion, a gasket configured as a separate member may be bonded to the loudspeaker diaphragm, to thereby obtain a loudspeaker. Further, as illustrated in FIG. 4, the loudspeaker according to the present invention may practically include a magnetic circuit member 50 and a frame 60.

A-1. Diaphragm Portion

The above-mentioned diaphragm portion contains any appropriate resin. It is preferred to use, as the resin contained in the diaphragm portion, a resin excellent in adhesion (welding property) with respect to a polymer (described below) contained in the edge portion. This is because it is possible to obtain high adhesion when the diaphragm portion is molded integrally with the edge portion. Examples of the resin described above include a polyolefin-based thermoplastic resin. Specific examples of the polyolefin-based thermoplastic resin include polypropylene (PP), polyethylene (PE), poly (1-butene), polyisobutene, polymethylpentene, and combinations of two or more thereof. By using the resins described above, it is possible to obtain a lightweight loudspeaker diaphragm having an advantage in internal loss. The polypropylene is most preferred. This is because the polypropylene is excellent in balance of strength, lightness in weight, and versatility.

A solubility parameter of the resin contained in the above-mentioned diaphragm portion may be set depending on a kind of the polymer contained in the edge portion. The resin contained in the diaphragm portion has a solubility parameter of preferably 7.8 $(J/cm^3)^{1/2}$ to 10 $(J/cm^3)^{1/2}$, more preferably 7.9 $(J/cm^3)^{1/2}$ to 8.2 $(J/cm^3)^{1/2}$.

A resin content in the diaphragm portion is preferably 45% by weight to 95% by weight, more preferably 55% by weight to 90% by weight, and particularly preferably 65% by weight to 80% by weight.

The above-mentioned diaphragm portion may contain any appropriate additive. Examples of the additive include an inorganic filler and grain.

When the above-mentioned diaphragm portion contains the inorganic filler, it is possible to obtain a loudspeaker diaphragm excellent in heat resistance and strength. Specific examples of the inorganic filler include glass fiber and mica. The above-mentioned glass fiber has a fiber length of preferably 0.1 mm to 2 mm, more preferably 0.5 mm to 1 mm. Further, the glass fiber has a fiber diameter of preferably 3 μm to 24 μm, more preferably 5 μm to 10 μm.

Any appropriate grain is used as the above-mentioned grain. Specific examples of the grain include rice, corn, barley, wheat, rye, millet called as kibi, awa, or hie in Japanese, and sugarcane. They may be used alone or in combination. The rice is most preferred in the grain. As the rice, not only food rice but also non-food stock rice can be used. Use of the stock rice, i.e., surplus rice to be discarded, may have an advantage in production cost and environment.

An inorganic filler content in the diaphragm portion is preferably 5% by weight to 55% by weight, more preferably 10% by weight to 35% by weight. A grain content in the diaphragm portion is preferably 10% by weight to 50% by weight, more preferably 20% by weight to 30% by weight.

Examples of other additives which may be contained in the diaphragm portion include a pigment (carbon black), a flame retardant, an anti-aging agent, an antistatic agent, an antibacterial agent, an antioxidant, an inorganic hollow filler, an inorganic filler, an organic filler, a release agent, a light stabilizer, a tackifier, and an adhesive elastomer. The number, kinds, and amount of the additives may be appropriately selected depending on purposes.

Any appropriate shape may be adopted as the shape of the above-mentioned diaphragm portion. The diaphragm portion has preferably a dome shape. When the diaphragm portion has a dome shape, the voice coil may be arranged at a position close to the bonding portion between the diaphragm portion and the edge portion, and hence it is possible to obtain a loudspeaker diaphragm having less divided vibration.

A-2. Edge Portion

The above-mentioned edge portion contains at least one thermoplastic polymer (I), in combination with and a block copolymer (II). The at least one thermoplastic polymer (I) may be selected from a block copolymer (I-a) which contains a polymer block (A) having a repeating structural unit derived from an aromatic vinyl compound and a polymer block (B) having a repeating structural unit derived from a conjugated diene, and an addition hydrogenated block copolymer (I-b) of the block copolymer (I-a) (which may also be referred to as a hydrogen additive (I-b) of the block copolymer (I-a)). The block copolymer (II) contains a polymer block (C) having a repeating structural unit derived from an olefin compound and a polymer block (D) having a repeating structural unit derived from a (meth)acrylic compound. Thus, by using the specific polymers in combination, it is possible to obtain an edge portion which has low hardness and excellent elongation and has excellent adhesion to the diaphragm portion.

The above-mentioned block copolymer (I-a) contains a polymer block (A) having a repeating structural unit derived from an aromatic vinyl compound and a polymer block (B)

having a repeating structural unit derived from a conjugated diene. The sequence of the blocks is not limited, for example, the block copolymer (I-a) may be a diblock copolymer or a triblock copolymer. The content of the polymer block (A) in the block copolymer (I-a) is preferably 10% by mass to 70% by mass, more preferably 20% by mass to 65% by mass. The weight-average molecular weight of the block copolymer (I-a) is not limited, and may be, for example, 60,000 to 400,000.

Examples of the above-mentioned aromatic vinyl compound include styrene, methylstyrene, ethylstyrene, propylstyrene, iso propylstyrene, butylstyrene, tert-butylstyrene, alkylstyrene such as dimethylstyrene, alkoxystyrene such as methoxystyrene, phenylstyrene, divinylbenzene, and combinations of two or more thereof. Among them, styrene may be preferably used.

Examples of the above-mentioned conjugated diene include isoprene, butadiene, pentadiene, hexadiene, heptadiene, and combinations of two or more thereof. Among them, isoprene, butadiene, and hexadiene may be preferably used.

The above-mentioned block copolymer (I-a) may be obtained by using the aromatic vinyl compound and the conjugated diene according to any appropriate production method. Further, an example of a commercially available product that may be used as the block copolymer (I-a) is sold under the trade name "HYBRAR" of non-hydrogenated grades from Kuraray Co., Ltd.

The above-mentioned addition hydrogenated block copolymer (I-b) may be obtained by addition hydrogenation of the block copolymer (I-a) according to any appropriate production method. With respect to the number of moles of an unsaturated double bond contained in the polymer block (B) of the block copolymer (I-a), a hydrogenation rate of the addition hydrogenated block copolymer (I-b) is preferably 70% or more, more preferably 80% or more, particularly preferably 90% to 100%. With such a hydrogenation rate, it is possible to more suitably obtain an edge portion which has low hardness and excellent elongation.

The above-mentioned block copolymer (II) contains a polymer block (C) having a repeating structural unit derived from an olefin compound and a polymer block (D) having a repeating structural unit derived from a (meth)acrylic compound. The sequence of the blocks is not limited, for example, the block copolymer (II) may be a diblock copolymer or a triblock copolymer, and is preferably a diblock copolymer. The content of the polymer block (C) in the block copolymer (II) is preferably 20% by mass to 70% by mass, more preferably 40% by mass to 60% by mass. The weight-average molecular weight of the block copolymer (II) is not limited, and may be, for example, 300 to 100,000.

Examples of the above-mentioned olefin compound include ethylene, propylene, isobutylene, 1-butene, isobutene, pentene, methylpentene, and combinations of two or more thereof. Among them, propylene may be preferably used. This is because the propylene is excellent in balance of strength, lightness in weight, and versatility.

As the above-mentioned (meth)acrylic compound, (meth)acrylate and the derivatives thereof may be used. Examples of the derivatives include ester (meth)acrylate such as methyl (meth)acrylate, ethyl (meth)acrylate, n-propyl(meth)acrylate, 2-ethylhexyl(meth)acrylate, and dodecyl(meth)acrylate; ester(meth)acrylate having an epoxy group such as glycidyl (meth)acrylate; ester(meth)acrylate having a hydroxyl group such as 2-hydroxyethyl(meth)acrylate, 2-hydroxypropyl (meth)acrylate, 4-hydroxybutyl(meth)acrylate, and 2-hydroxyhexyl(meth)acrylate; (meth)acrylonitrile; and combinations of two or more thereof. Among them, methyl methacrylate, ethyl acrylate, acrylic acid, acrylonitrile, 2-ethylhexyl(meth)acrylate, dodecyl(meth)acrylate, 2-hydroxyhexyl(meth)acrylate, and glycidyl(meth)acrylate may be preferably used. This is because an edge portion which has both elongation and strength and has excellent adhesion to the diaphragm portion may be suitably obtained. In addition, "(meth)acrylate" means acrylate or methacrylate in the present specification.

The above-mentioned block copolymer (II) may be obtained by using the olefin compound and the (meth)acrylic compound according to any appropriate production method. Further, an example of a commercially available product that may be used as the block copolymer (II) is sold under the trade name "Nucrel" from Dupont-Mitsui Polychemicals Co., Ltd.

When the below-described olefin polymer (III) and/or process oil is/are not contained in the edge portion: with respect to 100 parts by weight of the thermoplastic polymer (I), the content of the above-mentioned block copolymer (II) in the edge portion is preferably 5 parts by weight to 95 parts by weight, more preferably 30 parts by weight to 70 parts by weight. When the olefin polymer (III) and/or process oil is/are contained in the edge portion: with respect to 100 parts by weight of the total of the thermoplastic polymer (I) and these components, the content of the above-mentioned block copolymer (II) in the edge portion is preferably 5 parts by weight to 95 parts by weight, more preferably 30 parts by weight to 70 parts by weight. When the content of the above-mentioned block copolymer (II) is less than 5 parts by weight, adhesion to the diaphragm portion may be insufficient. Further, when the content of the above-mentioned block copolymer (II) is more than 95 parts by weight, hardness is increased, and hence it may adversely affect characteristics in a low frequency range.

As described above, the edge portion may further contain at least one selected from the olefin polymer (III) and the process oil. When the edge portion contains such components, adhesion to the diaphragm portion and release characteristics from a die in molding may be improved. For example, since the above-mentioned addition hydrogenated block copolymer (I-b) has low polarity and high surface tackiness, adhesion to the diaphragm portion and release characteristics from a die tend to decrease when the addition hydrogenated block copolymer (I-b) is used as the thermoplastic polymer (I). However, when the olefin polymer (III) and/or process oil is/are contained, it is possible to preferably achieve the effect, for example, it may be possible to produce continuously.

Examples of the olefin polymer (III) include polypropylene (PP), polyethylene (PE), poly(1-butene), polyisobutene, polymethylpentene, and combinations of two or more thereof. Among them, polypropylene may be preferably used. The weight-average molecular weight of the olefin polymer (III) is not limited, and may be 100 to 50,000.

Examples of the process oil include a paraffinic oil, a naphthenic oil, a silicone oil, an aromatic oil, a vegetable oil, and combinations of two or more thereof.

With respect to 100 parts by weight of the thermoplastic polymer (I), the content of the above-mentioned olefin polymer (III) and/or process oil in the edge portion (the total of the olefin polymer (III) and process oil when they are both contained) is preferably 10 parts by weight to 500 parts by weight, more preferably 20 parts by weight to 300 parts by weight, particularly preferably 20 parts by weight to 200 parts by weight. When the content of the above-mentioned olefin polymer (III) and/or process oil is less than 10 parts by weight, the effect of improving release characteristics and the effect of improving adhesion to the diaphragm portion may not be sufficiently obtained. Further, when the content of the above-mentioned olefin polymer (III) and/or process oil is more than 500 parts by weight, strength is lowered, and hence durability may be insufficient.

The edge portion may contain any appropriate additive. Examples of the additive include an additive similar to the additive described above in the item "A-1".

In one embodiment, the edge portion may be a foam material. When the edge portion is a foam material, it is possible to improve internal loss and achieve weight saving.

The above-mentioned foam material has an expansion ratio of preferably 110% to 300%, more preferably 120% to 200%. With this expansion ratio, it is possible to achieve both practically sufficient strength and weight saving.

The edge portion has a JIS-A hardness of preferably 15° to 55°, more preferably 25° to 55°, and particularly preferably 35° to 55°. With this range, it is possible to obtain a loudspeaker diaphragm and a loudspeaker which are excellent in linearity even at the time of large amplitude.

The edge portion has a tensile elongation at break (determined according to JIS-K 6251) of preferably 500% to 1000%. With this range, it is possible to obtain a loudspeaker diaphragm and a loudspeaker which are excellent in linearity even at the time of large amplitude.

The edge portion has a density of preferably 0.3 g/cm$^3$ to 1.2 g/cm$^3$, more preferably 0.3 g/cm$^3$ to 1.0 g/cm$^3$. With this density, it is possible to achieve both practically sufficient strength and weight saving. For example, when the edge portion is a foam material, it is possible to realize a density of 0.3 g/cm$^3$ to 0.7 g/cm$^3$ while strength is maintained.

A-3. Gasket Portion

The above-mentioned gasket portion contains any appropriate resin. A resin similar to the resin contained in the diaphragm portion described above in the item "A-1" may be used in the gasket portion. A material forming the gasket portion is preferably the same as the material forming the above-mentioned diaphragm portion.

B. Method of Producing Loudspeaker Diaphragm

The diaphragm portion and the edge portion of the loudspeaker diaphragm according to the present invention are produced by integral molding. More specifically, in the loudspeaker diaphragm according to the present invention, the diaphragm portion and the edge portion are made of different materials, and hence those members are molded integrally with each other by double molding. Thus, by undergoing the double molding, the different materials can be bonded to each other in a molten state to be firmly welded together, with the result that it is possible to obtain a loudspeaker diaphragm having high strength in the bonding portion and having less divided vibration. Further, an adhesive is not used, and hence there is no problem with a variation in adhesive application amount, and hence it is possible to obtain a loudspeaker diaphragm excellent in stability of quality. In addition, the number of components and man-hours can be reduced, and hence it is possible to obtain a loudspeaker and a loudspeaker diaphragm at low cost.

Any appropriate method may be adopted as a method of the above-mentioned double molding. In the above-mentioned double molding, the diaphragm portion may be molded in a primary molding and the edge portion may be molded in a secondary molding. Alternatively, the edge portion may be molded in the primary molding and the diaphragm portion may be molded in the secondary molding. Preferably, the diaphragm portion is molded in the primary molding and the edge portion is molded in the secondary molding. In the following, an embodiment in which the diaphragm portion is molded in the primary molding and the edge portion is molded in the secondary molding is described.

Figure 5A:
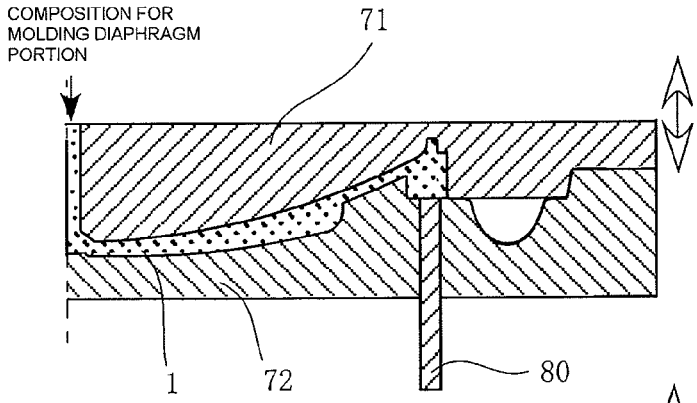
FIGS. 5A to 5C are schematic views schematically illustrating a method of producing a loudspeaker diaphragm according to a preferred embodiment of the present invention.
Figure 5B:
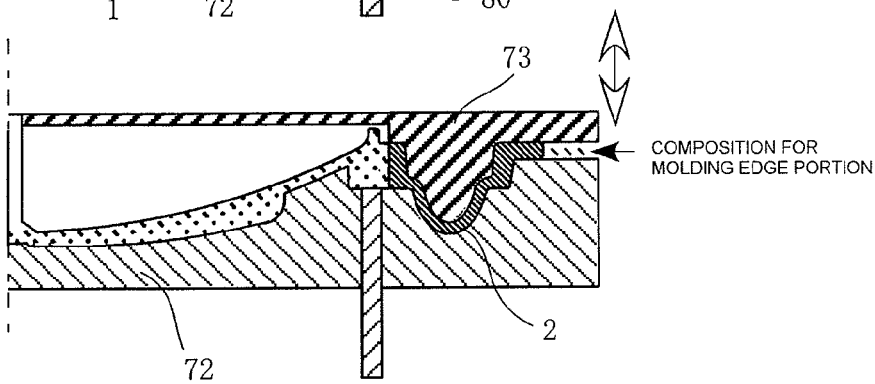
Figure 5C:
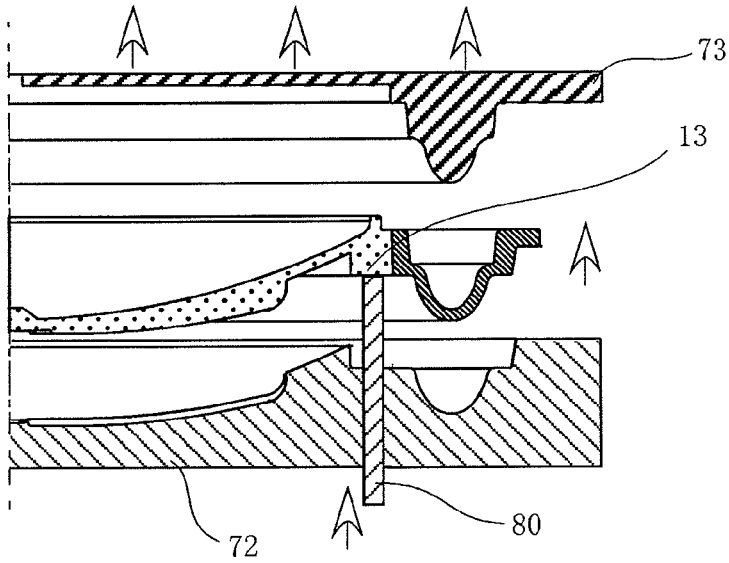

FIGS. 5A to 5C are schematic views schematically illustrating a method of producing a loudspeaker diaphragm according to a preferred embodiment of the present invention. FIG. 5A schematically illustrates a method of the primary molding in the producing method. FIG. 5B schematically illustrates a method of the secondary molding in the producing method. FIG. 5C schematically illustrates a method of taking a molded product (loudspeaker diaphragm) out of dies in the producing method. According to the producing method illustrated in FIGS. 5A to 5C, the loudspeaker diaphragm of the present invention is obtained with good release characteristics.

In the primary molding, as illustrated in FIG. 5A, a composition for molding a diaphragm portion is injected into a first cavity 1 which is formed by a first die 71 and a second die 72, for molding the diaphragm portion. Thus, the diaphragm portion is molded.

The second die 72 of the embodiment illustrated in FIGS. 5A to 5C has a through-hole formed therein. The second die 72 may have the plurality of through-holes formed therein. At the time of the primary molding and the secondary molding, into each of the through-holes, there is inserted an ejector pin 80 having the same diameter as that of the through-hole. The through-hole is provided preferably at a position corresponding to the protruding portion 13 of the above-mentioned diaphragm portion 10, and the protruding portion 13 may have a surface on which the ejector pin 80 abuts.

The composition for molding a diaphragm portion contains structural components (resin and any component) described in the item "A-1". The content of each structural component in the composition for molding a diaphragm portion is as described in the item "A-1".

A condition for injection molding performed in the primary molding (for example, temperature, injection speed, pressure, etc.) can be set appropriately depending on a kind of the material.

In the secondary molding, as illustrated in FIG. 5B, after the first die 71 is released, a second cavity 2 is formed by a third die 73 and the second die 72 each shaped so as to conform to the edge portion. Then, a composition for molding an edge portion is injected into the second cavity 2, to thereby mold the edge portion. A composition for molding an edge portion may be foamed and injected, to thereby mold the edge portion as needed. In this case, there may be provided steam vents (not illustrated) in the third die 73.

The above-mentioned composition for molding an edge portion contains structural components (thermoplastic polymer (I), block copolymer (II), and any component) described in the item "A-2". The content of each structural component in the composition for molding an edge portion is as described in the item "A-2".

When the edge portion is a foam material, the composition for molding an edge portion further contains a foaming agent. As the foaming agent, there may be used any appropriate foaming agent. Examples of the foaming agent include organic foaming agents such as an azo compound, a hydrazide compound, a semicarbazide compound or a triazole compound, and inorganic foaming agents such as hydrogen carbonates such as a sodium hydrogen carbonate or an ammonium hydrogen carbonate, carbonates such as a sodium carbonate or an ammonium carbonate, or nitrites such as a sodium nitrite or an ammonium nitrite.

In the composition for molding an edge portion, with respect to 100 parts by weight of the total content of the thermoplastic polymer (I) and the block copolymer (II), and the olefin polymer (III) and process oil when these are contained, the content of the above-mentioned foaming agent is preferably 0.1 parts by weight to 10 parts by weight. When the content of the above-mentioned foaming agent is less than 0.1 parts by weight, the expansion ratio decreases, and hence effects such as weight saving may not be sufficiently obtained. Further, when the content of the above-mentioned foaming agent is more than 10 parts by weight, strength is lowered, and hence durability may be insufficient. In addition, production costs may increase.

A condition for injection molding or foam injection molding performed in the secondary molding (for example, temperature, injection speed, pressure, etc.) can be set appropriately depending on a kind of the material.

After the secondary molding, the molded product (loudspeaker diaphragm) is taken out of the dies. Specifically, as illustrated in FIG. 5C, after the third die 73 is released, the ejector pin 80 which abuts on the protruding portion 13 of the diaphragm portion 10 is pushed up, and thus the molded product (loudspeaker diaphragm) can be released from and taken out of the second die 72.

Figure 6A:
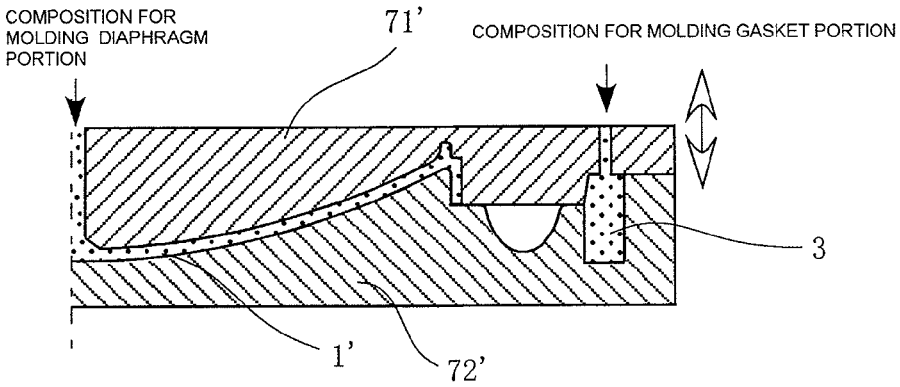
FIGS. 6A to 6C are schematic views schematically illustrating another method of producing a loudspeaker diaphragm according to a preferred embodiment of the present invention.
Figure 6B:
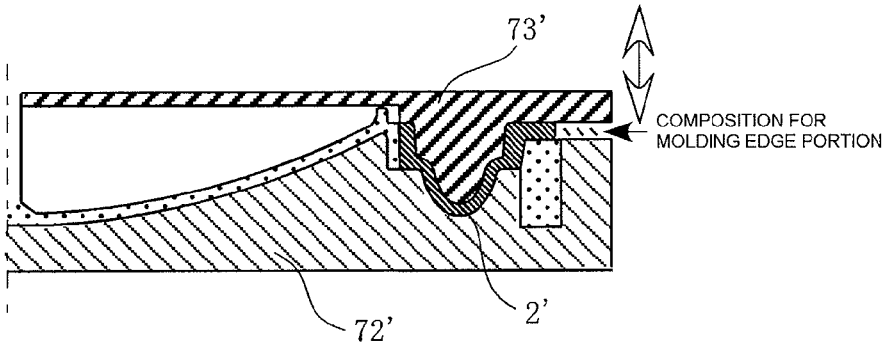
Figure 6C:
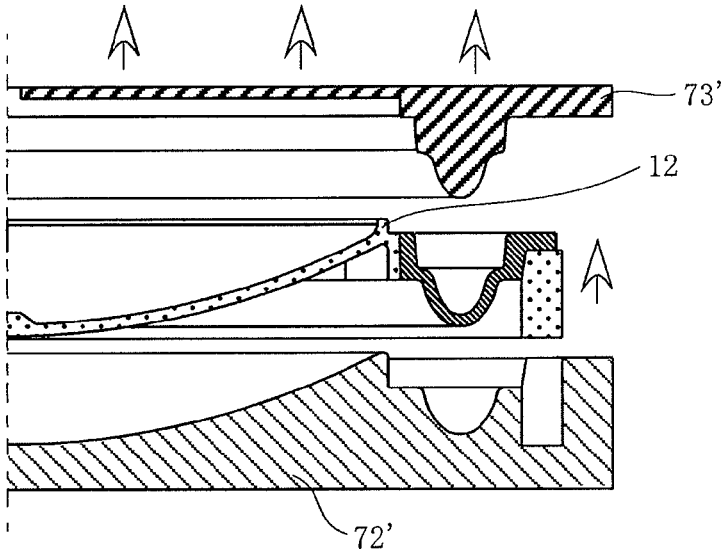

FIGS. 6A to 6C are schematic views schematically illustrating another method of producing a loudspeaker diaphragm according to the preferred embodiment of the present invention. FIG. 6A schematically illustrates a method of the primary molding in the producing method. FIG. 6B schematically illustrates a method of the secondary molding in the producing method. FIG. 6C schematically illustrates a method of taking a molded product (loudspeaker diaphragm) out of dies in the producing method. The loudspeaker diaphragm produced by the producing method includes the gasket portion. In the producing method, a third cavity 3 for forming the gasket portion is further formed by a first die 71' and a second die 72'.

In a case where the loudspeaker diaphragm according to the present invention includes the gasket portion, the diaphragm portion, the edge portion, and the gasket portion may be molded integrally with one another (molded by double molding in a case where, for example, the diaphragm portion and the gasket portion are made of the same material). In the case where the loudspeaker diaphragm according to the present invention includes the gasket portion, the diaphragm portion and the gasket portion are preferably made of the same material, and as illustrated in FIG. 6A and FIG. 6B, the diaphragm portion and the gasket portion are molded in the primary molding and the edge portion is molded in the secondary molding.

EXAMPLES

In the following, the present invention is described in further detail with reference to Examples, but the present invention is not limited to the Examples. Note that, all parts and percentages stated in Examples are based on weight unless stated otherwise.

Example 1

A loudspeaker diaphragm was produced according to the producing method illustrated in FIGS. 6A to 6C.

1. Primary Molding

As illustrated in FIG. 6A, the diaphragm portion and the gasket portion of the loudspeaker diaphragm having a voice coil guide portion were respectively molded in a first cavity 1' and the third cavity 3 formed by the first die 71' and the second die 72' (both the dies have a diameter (an outermost diameter) of 44.1 mm, a minor axis (an outermost diameter) of 19 mm). A composition and a molding condition of a primary molding composition (manufactured by Lion Idemitsu Composites Co., Ltd., trade name "MRP230-M2B") for forming the diaphragm portion and the gasket portion are as follows.

TABLE 1

| (Primary molding composition) | |
|---|---|
| Polypropylene resin | 70% |
| Mica | 25% |
| Carbon black | 5% |

<Molding Condition>

Cylinder temperature:

Hopper portion/Central part/Anterior part/Nozzle portion 190° C./210° C./230° C./230° C.

Die temperature: 40° C.

Injection speed: 25 mm/s

Screw rotation speed: 120 rpm

Back pressure: 5 Mpa

2. Secondary Molding

After the first die 71' was released, a second cavity 2' was formed by the second die 72' and a third die 73'. In the second cavity 2', the edge portion was molded using the composition for molding an edge portion under the same molding condition as that of the primary molding (FIG. 6B). Then, the molded product was taken out of the dies (FIG. 6C), and thus a loudspeaker diaphragm was obtained. A composition of a secondary molding composition for forming an edge portion is as follows.

TABLE 2

| (Secondary molding composition) | | |
|---|---|---|
| ① Thermoplastic polymer (I) | Hydrogen additive of triblock copolymer of polystyrene-polyisoprene-polystyrene (hydrogenation rate in polyisoprene 98 mol %) (manufactured by Kuraray Co., Ltd., trade name "HYBRAR") | 100 parts by weight |
| ② Block copolymer (II) | Diblock copolymer of polypropylene-polymethylmethacrylate (manufactured by Dupont-Mitsui Polychemicals Co., Ltd., trade name "Nucrel") | 43 parts by weight |
| ③ Antioxidant | (manufactured by Adeka Corporation, trade name "ADK STAB AO-series") | 0.1 parts by weight*[1] |

*[1]with respect to 100 parts by weight of the total of ① and ②

3. Assembly

A voice coil was inserted in and bonded to a portion (voice coil guide portion 12) situated directly below the bonding portion between the diaphragm portion and the edge portion of the loudspeaker diaphragm obtained by the above-mentioned molding. In addition, a frame and a magnetic circuit member were assembled using a jig, and thus a track shape loudspeaker having an outermost dimension of 20 mm×50 mm was obtained.

Example 2

A loudspeaker diaphragm and a loudspeaker were obtained in a similar way to that of Example 1, except that the secondary molding composition shown below was used. Release characteristics of a molded product in the secondary molding were superior to those of Example 1 and it was possible to realize continuous mass production.

TABLE 3

| (Secondary molding composition) | | |
|---|---|---|
| ① Thermoplastic polymer (I) | Hydrogen additive of triblock copolymer of polystyrene-polyisoprene-polystyrene (hydrogenation rate in polyisoprene 98 mol %) (manufactured by Kuraray Co., Ltd., trade name "HYBRAR") | 100 parts by weight |
| ② Block copolymer (II) | Diblock copolymer of polypropylene-polymethylmethacrylate (manufactured by Dupont-Mitsui Polychemicals Co., Ltd., trade name "Nucrel") | 103 parts by weight |
| ③ Olefin polymer (III) | Polypropylene (Japan Polypropylene Corporation, trade name "NOVATEC-PP") | 20 parts by weight |
| ④ Process oil | Paraffinic process oil (manufactured by Idemitsu Kosan Co., Ltd., trade name "PW-90") | 120 parts by weight |
| ⑤ Antioxidant | (manufactured by Adeka Corporation, trade name "ADK STAB AO-series") | 0.1 parts by weight*1 |

*1with respect to 100 parts by weight of the total of ① to ④

Example 3

A loudspeaker diaphragm and a loudspeaker were obtained in a similar way to that of Example 1, except that the secondary molding composition shown below was used.

TABLE 4

| (Secondary molding composition) | | |
|---|---|---|
| ① Thermoplastic polymer (I) | Hydrogen additive of triblock copolymer of polystyrene-polyisoprene-polystyrene (hydrogenation rate in polyisoprene 98 mol %) (manufactured by Kuraray Co., Ltd., trade name "HYBRAR") | 100 parts by weight |
| ② Block copolymer (II) | Diblock copolymer of polypropylene-polymethylmethacrylate (manufactured by Dupont-Mitsui Polychemicals Co., Ltd., trade name "Nucrel") | 43 parts by weight |
| ③ Antioxidant | (manufactured by Adeka Corporation, trade name "ADK STAB AO-series") | 0.1 parts by weight*1 |
| ④ Foaming agent | Sodium hydrogen carbonate (pyrolysis temperature: 150° C.) (manufactured by SANKYO KASEI Co., Ltd., trade name "Cellmic") | 2 parts by weight*1 |

*1with respect to 100 parts by weight of the total of ① and ②

Example 4

A loudspeaker diaphragm and a loudspeaker were obtained in a similar way to that of Example 1, except that the secondary molding composition shown below was used. Release characteristics of a molded product in the secondary molding were superior to those of Example 3 and it was possible to realize continuous mass production.

TABLE 5

| (Secondary molding composition) | | |
|---|---|---|
| ① Thermoplastic polymer (I) | Hydrogen additive of triblock copolymer of polystyrene-polyisoprene-polystyrene (hydrogenation rate in polyisoprene 98 mol %) (manufactured by Kuraray Co., Ltd., trade name "HYBRAR") | 100 parts by weight |
| ② Block copolymer (II) | Diblock copolymer of polypropylene-polymethylmethacrylate (manufactured by Dupont-Mitsui Polychemicals Co., Ltd., trade name "Nucrel") | 103 parts by weight |
| ③ Olefin polymer (III) | Polypropylene (Japan Polypropylene Corporation, trade name "NOVATEC-PP") | 20 parts by weight |
| ④ Process oil | Paraffinic process oil (manufactured by Idemitsu Kosan Co., Ltd., trade name "PW-90") | 120 parts by weight |
| ⑤ Antioxidant | (manufactured by Adeka Corporation, trade name "ADK STAB AO-series") | 0.1 parts by weight*1 |
| ⑥ Foaming agent | Sodium hydrogen carbonate (pyrolysis temperature: 150° C.) (manufactured by SANKYO KASEI Co., Ltd., trade name "Cellmic") | 2 parts by weight*1 |

*1with respect to 100 parts by weight of the total of ① to ④

Comparative Example 1

A loudspeaker diaphragm and a loudspeaker were obtained in a similar way to that of Example 1, except that the secondary molding composition shown below was used.

TABLE 6

| (Secondary molding composition) | | |
|---|---|---|
| ① Thermoplastic polymer (I) | Hydrogen additive of triblock copolymer of polystyrene-polyisoprene-polystyrene (hydrogenation rate in polyisoprene 98 mol %) (manufactured by Kuraray Co., Ltd., trade name "HYBRAR") | 100 parts by weight |
| ② Antioxidant | (manufactured by Adeka Corporation, trade name "ADK STAB AO-series") | 0.1 parts by weight |

Comparative Example 2

A loudspeaker diaphragm and a loudspeaker were obtained in a similar way to that of Example 1, except that the secondary molding composition shown below was used.

TABLE 7

| (Secondary molding composition) | | |
|---|---|---|
| ① Thermoplastic polymer (I) | Hydrogen additive of triblock copolymer of polystyrene-polyisoprene-polystyrene (hydrogenation rate in polyisoprene 98 mol %) (manufactured by Kuraray Co., Ltd., trade name "HYBRAR") | 100 parts by weight |
| ② Olefin polymer (III) | Polypropylene (Japan Polypropylene Corporation, trade name "NOVATEC-PP") | 20 parts by weight |

TABLE 7-continued

| (Secondary molding composition) | | |
|---|---|---|
| ③ Process oil | Paraffinic process oil (manufactured by Idemitsu Kosan Co., Ltd., trade name "PW-90") | 120 parts by weight |
| ④ Antioxidant | (manufactured by Adeka Corporation, trade name "ADK STAB AO-series") | 0.1 parts by weight*1 |

*1 with respect to 100 parts by weight of the total of ① to ③

<Evaluation>

The following evaluations were performed on the loudspeaker diaphragms and the loudspeakers obtained in Examples 1 to 4 and Comparative Examples 1 and 2. The results are shown in Table 8. In addition, the measurement methods are as follows.

<Density of Edge Portion>

The density of the edge portion of each of the loudspeaker diaphragms was measured in accordance with JIS K7112.

<Tensile Strength at Break and Elongation at Break of the Edge Portion>

Tensile strength at break and elongation at break of the edge portion of each of the loudspeaker diaphragms were measured in accordance with JIS K6251.

<Adhesion Between Diaphragm Portion and Edge Portion>

The maximum value of adhesion between the diaphragm portion and the edge portion of each of the loudspeaker diaphragms was measured when the gasket portion of the loudspeaker diaphragm was fixed and a load was applied to the diaphragm portion. The adhesion was measured with a load in the upper and lower direction.

<Expansion Ratio of Edge Portion>

The expansion ratio of the edge portion of each of the loudspeaker diaphragms was calculated based on the specific gravity before and after foaming.

<Hardness of Edge Portion>

The hardness of the edge portion of each of the loudspeaker diaphragms was measured by using Durometer Type A in accordance with JIS K6253.

<Fo Decreasing Rate>

A continuous load test of input 2 w-100 hr (input signal: DIN noise) was performed on each of the loudspeakers and Fo change rate before and after the test was calculated.

TABLE 8

| | | | Example 1 | Example 2 | Example 3 | Example 4 | Comparative Example 1 | Comparative Example 2 |
|---|---|---|---|---|---|---|---|---|
| Density | | $g/cm^3$ | 0.9 | 0.9 | 0.56 | 0.6 | 0.88 | 0.88 |
| Tensile strength at break | | MPa | 10.4 | 11 | 6.5 | 7.3 | 4.2 | 6 |
| Elongation at break | | % | 750 | 930 | 750 | 930 | 450 | 570 |
| Hardness | | | 40 | 40 | 35 | 34 | 60 | 58 |
| Adhesion | Upper direction | N | 29 | 31 | 29 | 31 | 15 | 18 |
| | Lower direction | | 33 | 34 | 33 | 34 | 19 | 23 |
| Expansion ratio | | % | — | — | 160 | 150 | — | — |
| Fo decreasing rate | | % | 12 | 11 | — | — | 36 | 34 |

As is apparent from the results of Example 1 and Comparative Example 1, when the thermoplastic polymer (I) and the block copolymer (II) are used in combination, it is possible to improve adhesion between the diaphragm portion and the edge portion, and the edge portion having high strength and elongation can be obtained. Further, when the olefin polymer (III) and the process oil are included, it is possible to further improve adhesion, and strength and elongation of the edge portion. Regarding durability, Fo decreasing rate of each of the loudspeakers according to Examples 1 and 2 is apparently smaller than those of the loudspeakers according to Comparative Examples 1 and 2, and hence it can be seen that the loudspeakers according to Examples 1 and 2 are excellent in stability of quality. In addition, it can be seen from the results of the Examples 3 and 4 that even if the edge portion is a foam material, it is possible to improve adhesion between the diaphragm portion and the edge portion, and to realize higher strength and elongation as compared to Comparative Examples 1 and 2. Thus, the loudspeaker diaphragms and the loudspeaker excellent in durability can be obtained.

The loudspeaker diaphragm and the loudspeaker using the same according to the present invention may be suitably used for various purposes, and may be suitably used particularly for a compact loudspeaker for portable electronic devices (for example, laptop computer, mobile phone, and portable music player).

What is claimed is:

1. A loudspeaker diaphragm, comprising:

a diaphragm portion, the diaphragm portion comprising at an outer peripheral end thereof an outer wall portion having a surface provided upright in a direction substantially parallel to a vibrating direction of the diaphragm portion at an outermost end of the diaphragm portion, the surface of the outer wall portion has a height in the direction substantially parallel to the vibrating direction of the diaphragm portion larger than a thickness of the diaphragm portion; and an edge portion, which is molded integrally with the diaphragm portion and made of a material different from a material for the diaphragm portion, the edge portion comprising an inner peripheral surface bonded with the surface of the outer wall portion of the diaphragm portion, wherein:

the edge portion comprises at least one thermoplastic polymer (I), in combination with a block copolymer (II);

the at least one thermoplastic polymer (I) is selected from a block copolymer (I-a) comprising a polymer block (A) having a repeating structural unit derived from an aromatic vinyl compound and a polymer block (B) having a repeating structural unit derived from a conjugated diene, and an addition hydrogenated block copolymer (I-b) of the block copolymer (I-a), wherein the hydrogenation rate of the addition hydrogenated block copolymer (I-b) is 70% or more with respect to the number of moles of an unsaturated double bond contained in the polymer block (B); and the block copolymer (II) comprises a polymer block (C) having a repeating structural unit derived from an olefin compound and a polymer block (D) having a repeating structural unit derived from a (meth)acrylic compound.

2. A loudspeaker diaphragm according to claim 1, wherein the edge portion comprises 5 parts by weight to 95 parts by weight of the block copolymer (II) with respect to 100 parts by weight of the thermoplastic polymer (I).

3. A loudspeaker diaphragm according to claim 1, wherein the conjugated diene is selected from at least one of isoprene, butadiene, and hexadiene.

4. A loudspeaker diaphragm according to claim 1, wherein the (meth)acrylic compound is selected from at least one of methyl methacrylate, ethyl acrylate, acrylic acid, acrylonitrile, 2-ethylhexyl (meth)acrylate, dodecyl (meth)acrylate, 2-hydroxyhexyl (meth)acrylate, and glycidyl (meth)acrylate.

5. A loudspeaker diaphragm according to claim 1, wherein the edge portion further comprises at least one selected from an olefin polymer (III) and process oil.

6. A loudspeaker diaphragm according to claim 5, wherein the edge portion comprises 10 parts by weight to 500 parts by weight of at least one selected from the olefin polymer (III) and the process oil with respect to 100 parts by weight of the thermoplastic polymer (I).

7. A loudspeaker diaphragm according to claim 5, wherein the edge portion comprises 5 parts by weight to 95 parts by weight of the block copolymer (II) with respect to 100 parts by weight of the total of the thermoplastic polymer (I) and at least one selected from the olefin polymer (III) and the process oil.

8. A loudspeaker diaphragm according to claim 1, wherein the edge portion has a JIS-A hardness of 15° to 55°.

9. A loudspeaker diaphragm according to claim 1, wherein the edge portion is a foam material.

10. A loudspeaker diaphragm according to claim 1, wherein the loudspeaker diaphragm further comprises a gasket portion which is made of the same material as the material for the diaphragm portion and is molded integrally with and bonded to an outer peripheral portion of the edge portion.

11. A loudspeaker, comprising:

the loudspeaker diaphragm according to claim 1.

* * * * *